US005147197A

United States Patent [19]

Hodan et al.

[11] Patent Number: 5,147,197

[45] Date of Patent: Sep. 15, 1992

[54] SEALING PLATE FOR A SPINNERETTE ASSEMBLY

[75] Inventors: John A. Hodan, Arden; Robert N. Armstrong, Ashville; Robert E. First, Candler, all of N.C.

[73] Assignee: BASF Corporation, Parsippany, N.J.

[21] Appl. No.: 633,810

[22] Filed: Dec. 26, 1990

[51] Int. Cl.[5] ..... B29C 47/12

[52] U.S. Cl. ..... 425/192 S; 264/39; 264/169; 425/464

[58] Field of Search ..... 264/39, 40.1, 176.1, 264/169, 103, 171; 425/72.2, 131.5, 185, 192 S, 382.2, 198, 466, 464

[56] References Cited

U.S. PATENT DOCUMENTS

| | | | |
|---|---|---|---|
| 2,428,046 | 9/1947 | Sisson et al. | 264/171 |
| 2,539,128 | 1/1951 | Gray | 425/198 |
| 2,883,261 | 4/1959 | McGeorge, Jr. | 425/198 |
| 3,028,627 | 4/1962 | McCormick | 425/198 |
| 3,095,607 | 7/1963 | Cobb, Jr. | 425/198 |
| 3,176,345 | 4/1965 | Powell | 425/192 S |
| 3,225,383 | 12/1965 | Cobb, Jr. | 425/198 |
| 3,289,249 | 12/1966 | Nakayama et al. | 425/76 |
| 3,299,471 | 1/1967 | Hench | 425/192 S |
| 3,336,633 | 8/1967 | Currann, Jr. | 425/198 |
| 3,601,846 | 8/1971 | Hudnall | 425/198 |
| 3,659,988 | 5/1972 | Walczak | 425/198 |
| 4,301,101 | 11/1981 | Bachmann et al. | 264/169 |
| 4,362,495 | 12/1982 | Naito et al. | 425/466 |
| 4,479,768 | 10/1984 | Kube et al. | 425/466 |
| 4,615,670 | 10/1986 | Brandt et al. | 425/192 S |
| 4,738,607 | 4/1988 | Nakajima et al. | 425/198 |
| 4,761,129 | 8/1988 | Aste et al. | 264/169 |
| 4,842,503 | 6/1989 | Judge | 425/72.2 |
| 4,915,612 | 4/1990 | Gangeme et al. | 425/466 |

FOREIGN PATENT DOCUMENTS

| | | | |
|---|---|---|---|
| 54-38362 | 3/1979 | Japan | 264/176.1 |
| 61-132610 | 6/1986 | Japan | 264/39 |

*Primary Examiner*—Jay H. Woo
*Assistant Examiner*—Robert B. Davis

[57] ABSTRACT

A device for changing the filament count from a spinnerette assembly includes a sealing plate positioned upstream from the spinnerette assembly to prevent the passage of the material being spun into one or more particular spinnerette bores.

1 Claim, 1 Drawing Sheet

SEALING PLATE FOR A SPINNERETTE ASSEMBLY

BACKGROUND OF THE INVENTION

This invention relates generally to melt spinning filaments or fibers using a spinnerette. More particularly, this invention relates to an apparatus for changing the number of filaments being spun from a single spinnerette.

Spinnerette assemblies for spinning synthetic filaments or fibers typically include an inlet block having an inlet port through which the material to be spun is introduced into the spinnerette assembly and a chamber containing filtering material, a distribution plate, a distribution cavity, a metering plate and a spinnerette plate. The metering plate includes a number of apertures having a compound shape, consisting of a capillary and a counterbore. The spinnerette plate normally includes a corresponding number of bores having a compound shape consisting of a counterbore or capillary and a jet or spinning orifice. U.S. Pat. No. 3,095,607 to Cobb describes a typical spinnerette assembly. Other spinnerette assemblies are described in U.S. Pat. No. 3,028,627 to McCormick, U.S. Pat. No. 2,883,261 to McGeorge, U.S. Pat. No. 3,225,383 to Cobb, U.S. Pat. No. 3,289,249 to Nakayama et al., U.S. Pat. No. 3,601,846 to Hudnall, U.S. Pat. No. 3,659,988 to Walczak, and U.S. Pat. No. 4,738,607 to Nakajima et al.

It is sometimes desirable to change the number of filaments being spun from a single spinnerette. Reasons for altering the filament count may include product variations, keeping the tow denier constant while changing the filament denier, changing quenching characteristics and maintaining spinning speed at higher denier per filament where extruder capacity is limited.

The traditional method for changing filament count is to individually plug spinnerette capillaries using a soft metal bar of approximately the same diameter as the counterbore. This method is time consuming, risks damage to the spinnerette and does not insure a leak-free seal.

Another known method for spinning a number of different filament counts from a single spinnerette plate is described in U.S. Pat. No. 3,336,633 to Curran. Curran employs metering plates having a number of apertures lower than the number of orifices in the spinnerette plate. Since the compound shape of the apertures in the metering plate are normally precision drilled to provide a desired pressure drop, the metering plates are relatively expensive to produce and maintaining a stockpile of metering plates to provide a variety of fiber counts may be cost-prohibitive.

SUMMARY OF THE INVENTION

It is an object of the invention to provide a simple and inexpensive apparatus for changing the filament count from a spinnerette plate.

It is also an object of the invention to provide an apparatus which provides a good seal of one or more capillaries of a spinnerette plate.

These objectives and other advantages are achieved by providing a sealing plate adjacent to the upstream side of the spinnerette plate. The sealing plate contains a number of flow channels. The number of flow channels in the sealing plate is lower than the number of orifices in the spinnerette plate. Each of the flow channels corresponds in position to a bore in the spinnerette plate. The sealing plate may be sandwiched between a metering plate and the spinnerette plate in which case the sealing plate changes the filament count from the spinnerette by blocking the metering aperture and preventing the material being spun from passing to the spinnerette orifice corresponding to the blocked metering aperture.

The present invention will be described more fully hereinafter with reference to the accompanying drawings, in which illustrative embodiments of the invention are shown. This invention can, however, be embodied in many different forms and the invention should not be construed as being limited to the specific embodiments set forth herein. Rather, applicant provides these embodiments so that this disclosure will be thorough and complete and will fully convey the scope of the invention to those skilled in the art.

DETAILED DESCRIPTION OF THE PREFERRED EMBODIMENTS

Figure 1:
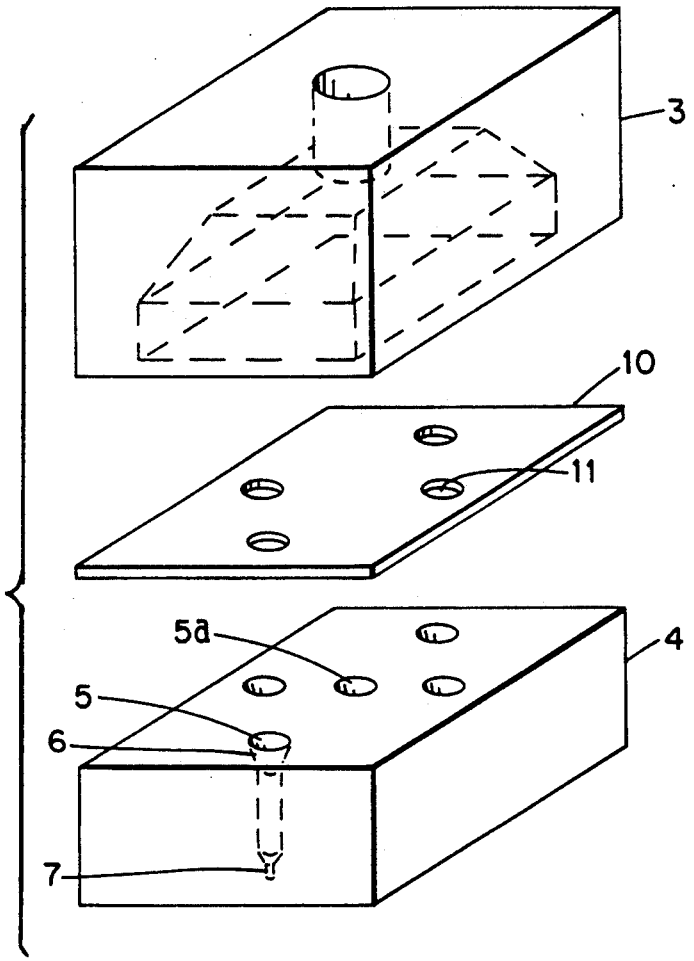
FIG. 1 is an exploded perspective view of a spinnerette assembly in accordance with the invention.

Referring now to FIG. 1, a spinnerette assembly includes an inlet block 3 and a spinnerette plate 4. The spinnerette plate 4 includes a number of bores 5. The bores 5 may be of compound shape, having a relatively large counterbore 6 at the upstream side and a relatively small spinning orifice 7 through which the material being spun exits the spinnerette plate 4.

Between the inlet block 3 and the spinnerette plate 4 is sealing plate 10. Sealing plate 10 includes one or more flow channels 11, each of which is positioned to correspond with one of the bores 5 in the spinnerette plate 4. The sealing plate 10 contains at least one less flow channel 11 than the number of bores 5 in the spinnerette plate 4. Thus, the sealing plate 10, will block at least one bore 5 of the spinnerette plate 4, preventing the passage of the material being spun, thereby changing the filament count from the spinnerette. As seen in FIG. 1, there is no flow channel corresponding to bore 5*a* in spinnerette plate 4, thereby changing the filament count from 5 to 4 from the illustrated spinnerette.

Sealing plate 10 can be manufactured from any suitable material, such as, for example, mild steel, stainless steel, brass or aluminum. Sealing plate 10 and flow channels can be formed by any suitable manufacturing technique such as, for example, die cutting, drilling, punching, stamping, etching, machining, or molding. Any suitable means may be employed to align the various components of the spinnerette assembly in precise registry with each other and to maintain the assembled spinnerette assembly in a tight fitting relationship. For example, apertures (not shown) may be formed in each component which, in the assembled spinnerette assembly, provide thruways accommodating terminally threaded aligning bolts or rods (not shown) which receive locking nuts (not shown).

The overall dimensions of the spinnerette plate 4 and the sealing plate 10 may vary considerably. In general, the spinnerette plate and the sealing plate will have the same or substantially the same planar dimensions. While in some instances spinnerette plates may be as large as a few feet in length, typically, the planar dimensions range from about 1.0 to about 12 inches in length and about 1.0 to about 8.0 inches in width. The thickness of the spinnerette and sealing plates may be the same or different. Preferably, however, the sealing plate 10 will be substantially thinner than the spinnerette plate 4. Typically, the thickness of the spinnerette plate 4 may be between about 0.25 to about 1.5 inches, while the thickness of the sealing plate 10 will preferably be between about 0.005 to about 0.1 inches.

The location or pattern of the bores 5 in spinnerette plate 4 and the corresponding flow channels 11 in sealing plate 10 may also vary considerably. Additionally, the diameter of the bores 5 and the flow channels may vary, ranging, for example, between about 0.1 to about 0.3 inches in diameter. Preferably, the diameter of the floW channel 11 corresponds to the diameter of the counterbore 6 at the upstream side of spinnerette plate 4.

Figure 2:
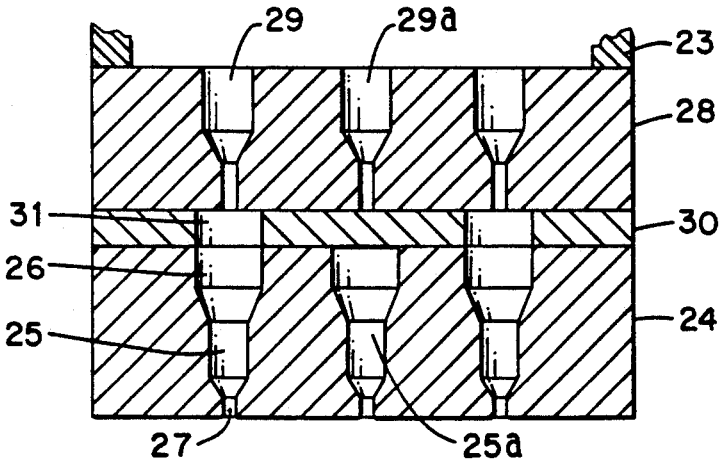
FIG. 2 is a partial axial longitudinal section of an alternative embodiment of a spinnerette assembly in accordance with the invention.

Referring now to FIG. 2, in another embodiment of the invention the spinnerette assembly includes an inlet block 23, a metering plate 28, and a spinnerette plate 24. Sealing plate 30 is located between the metering plate 28 and the spinnerette plate 24.

The metering plate 28 has a number of apertures 29 bored therein. The number and location of the apertures 29 in the metering plate 28 correspond to the number and location of bores 25 in the spinnerette plate 24. The sealing plate 30 includes a number of flow channels 31 formed therein.

The flow channels 31 are positioned to correspond with the apertures 29 in the metering plate 28 and the bores 25 in the spinnerette plate 24. The sealing plate 30 contains at least one less flow channel 31 than the number of apertures 29 and bores 25. Thus, the sealing plate 30 will prevent the passage of the material being spun from aperture 29a to bore 25*a*, thereby reducing the filament count from the spinnerette.

It should be understood that the sealing plate may be positioned adjacent to the upstream face of the metering plate, or at any other position in the spinnerette assembly provided that the sealing plate prevents the passage of the material to be spun into one or more particular spinnerette bores, thereby changing the filament count.

As will be appreciated by those skilled in the art, the cost of manufacturing a number of sealing plates for use in accordance with the present invention is significantly less than the cost of producing a corresponding number of metering plates or spinnerette plates to effect various changes in filament count. This is due primarily to the ease and simplicity of forming the flow channels in the sealing plate of the invention compared to the difficulties encountered in forming the compound shape of the precision drilled apertures in metering plates and spinnerette plates.

The foregoing description is to be considered illustrative rather than restrictive of the invention, and those modifications which come within the meaning and range of equivalence of the claims are to be included therein.

We claim:

1. A spinnerette assembly comprising:

a spinnerette plate with an upstream side and having a number of bores, each bore with one or more tapered sections; and a sealing plate adjacent to the upstream side of said spinnerette plate and forming an interface therewith, said sealing plate having cylindrical flow channels formed therein, said flow channels having a diameter corresponding to the diameter of said bores at the interface and being fewer in number than the number of bores in said spinnerette plate, each of said flow channels corresponding in position to a bore in said spinnerette plate; and a metering plate adjacent to the upstream side of said sealing plate, said metering plate having a number of metering apertures corresponding in number and location to the bores in said spinnerette plate.

* * * * *